US010920967B1

(12) United States Patent
Chen

(10) Patent No.: US 10,920,967 B1
(45) Date of Patent: Feb. 16, 2021

(54) NEON LAMP END CAP BOOT AND METHOD OF INSTALLATION

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 16/676,726

(22) Filed: Nov. 7, 2019

Related U.S. Application Data

(60) Provisional application No. 62/898,048, filed on Sep. 10, 2019.

(51) Int. Cl.

| | |
|---|---|
| ***F21V 17/10*** | (2006.01) |
| ***F21V 17/16*** | (2006.01) |
| ***H01J 61/36*** | (2006.01) |
| ***F21V 31/00*** | (2006.01) |

(52) U.S. Cl.
CPC ..... *F21V 17/107* (2013.01); *F21V 17/101* (2013.01); *F21V 17/164* (2013.01); *H01J 61/366* (2013.01); *F21V 31/005* (2013.01)

(58) Field of Classification Search
None
See application file for complete search history.

(56) References Cited

U.S. PATENT DOCUMENTS

| | | | | |
|---|---|---|---|---|
| D130,952 | S * | 12/1941 | Miller | D13/131 |
| 2,443,617 | A * | 6/1948 | Homan | H01J 17/066 313/288 |
| 2008/0112169 | A1* | 5/2008 | Cunius | F21V 17/12 362/249.07 |
| 2013/0045623 | A1* | 2/2013 | McGregor | H01R 12/616 439/391 |
| 2017/0198896 | A1* | 7/2017 | May | F21V 29/89 |

* cited by examiner

*Primary Examiner* — Britt D Hanley
(74) *Attorney, Agent, or Firm* — Stuart M. Goldstein

(57) ABSTRACT

An end cap boot has two end cap covers, each having a back wall, a side wall, and an interior pocket extending the length of the back wall and the width of the side wall. The end cap covers are configured to overlay one another, with the distal end of a neon lamp located therebetween, such that the pockets of the end cap covers fully encapsulates the distal end of the neon lamp. The method includes the injection of a glue material through one of the end cap covers, ensuring that the glue material completely fills the interior pockets surrounding the distal end of the lamp, thereby providing a permanent, waterproof seal at the end of the lamp. The end cap boot can be used both for fully enclosing a neon lamp or for enclosing the distal end of a lamp with extending electrical wiring.

20 Claims, 6 Drawing Sheets

NEON LAMP END CAP BOOT AND METHOD OF INSTALLATION

RELATED APPLICATION

The present application claims the benefit of provisional application Ser. No. 62/898,048, filed on Sep. 10, 2019.

FIELD OF THE INVENTION

This invention generally relates to the sealing and waterproofing of electrical neon lamps for installation.

BACKGROUND OF THE INVENTION

A securely sealed insulated electrical wire to tubular neon lamp connection is critical to the integrity of an installed neon lamp. Prior sealing components and the means for installing these components to accomplish secure and successful waterproofing seals have either resulted in failed and leaky connections or contain a multitude of components which are difficult to properly install.

SUMMARY OF THE INVENTION

It is thus the object of the present invention to provide a safe, secure, permanent, and waterproof seal for a neon lamp utilizing an end cap boot, including the method of installation of this end cap boot.

This and other objects are accomplished by the present invention, an end cap boot and its method of installation on the distal end of a neon lamp. The end cap boot has two end cap covers, each having a back wall, a side wall, and an interior pocket which extends the entire length of the back wall and the entire width of the side wall. The end cap covers are configured to overlay one another, with the distal end of a neon lamp located therebetween, such that the interior pockets of the end cap covers fully encapsulates the distal end of the neon lamp. The method includes the injection of a glue material through one of the end cap covers, ensuring that the glue material completely fills the interior pockets surrounding the distal end of the lamp, thereby providing a permanent, waterproof seal at the end of the lamp. The end cap boot can be used both for fully enclosing a neon lamp or for enclosing the distal end of a lamp with extending electrical wiring.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
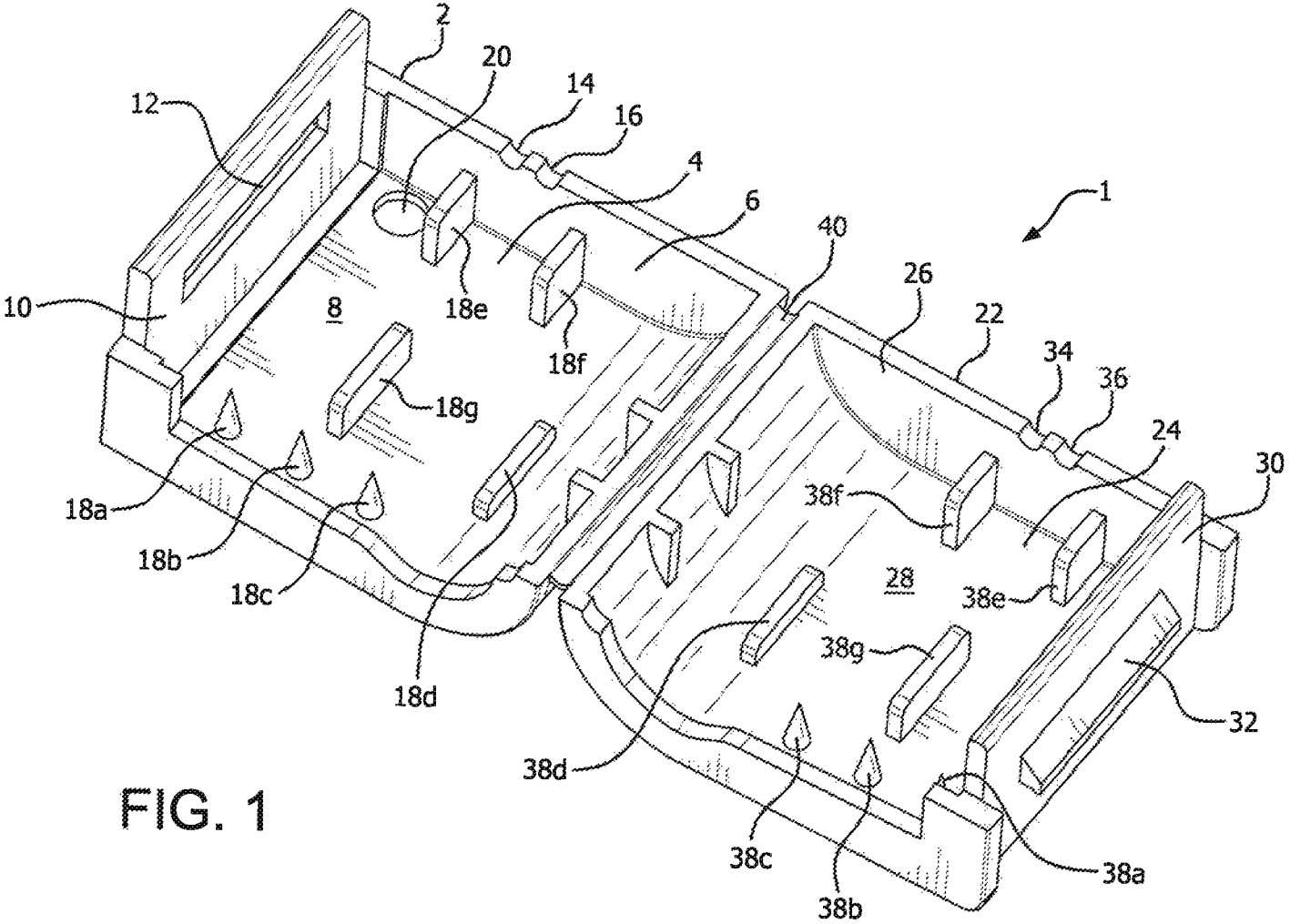
FIG. 1 is a top perspective view of the end cap boot of the present invention.
Figure 2:
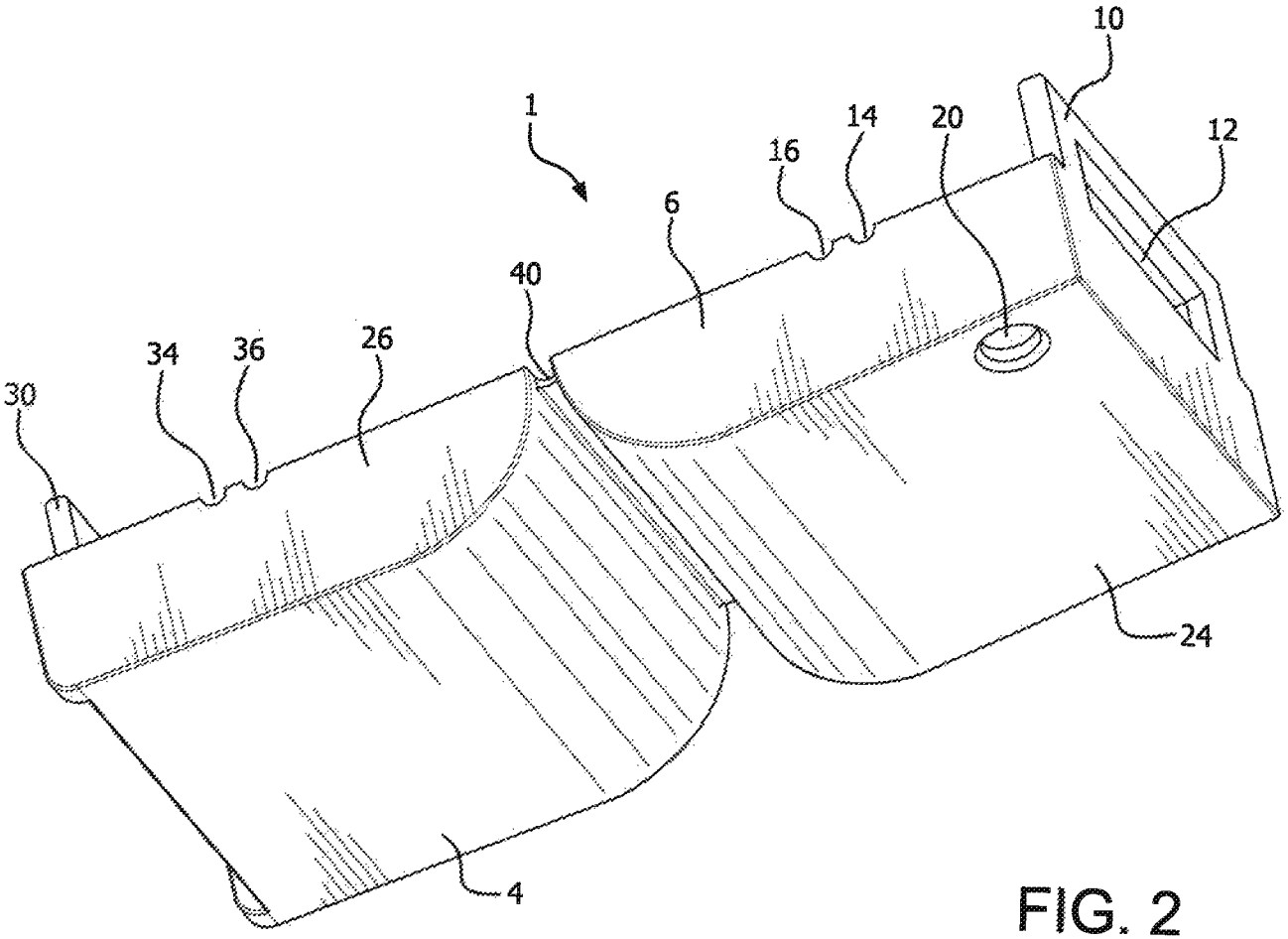
FIG. 2 is a bottom perspective view of the end cap boot of the present invention.

The end cap boot 1 of the present invention comprises first end cap cover 2 having back wall 4, side wall 6 and interior pocket 8 which extends the entire length of the back wall and the entire width of the side wall. First end cap cover 2 also comprises end wall 10 having slot 12. Lateral cut-out openings 14 and 16 are inset within side wall 6. Spacer members 18*a*-18*h* extend outward from back wall 4. Port 20 is located through back wall 4 of first end cap cover 2.

Second end cap cover 22 has back wall 24, side wall 26 and interior pocket 28 which extends the entire length of the back wall and the entire width of the side wall. Second end cap cover 22 also has end wall 30 with tab 32. Lateral cut-out openings 34 and 36 are inset within side wall 26. Spacer members 38*a*-38*h* extend outward from back wall 24. Hinge member 40 rotatably connects first end cap cover 2 to second end cap cover 22 of end cap boot 1.

Figure 3:
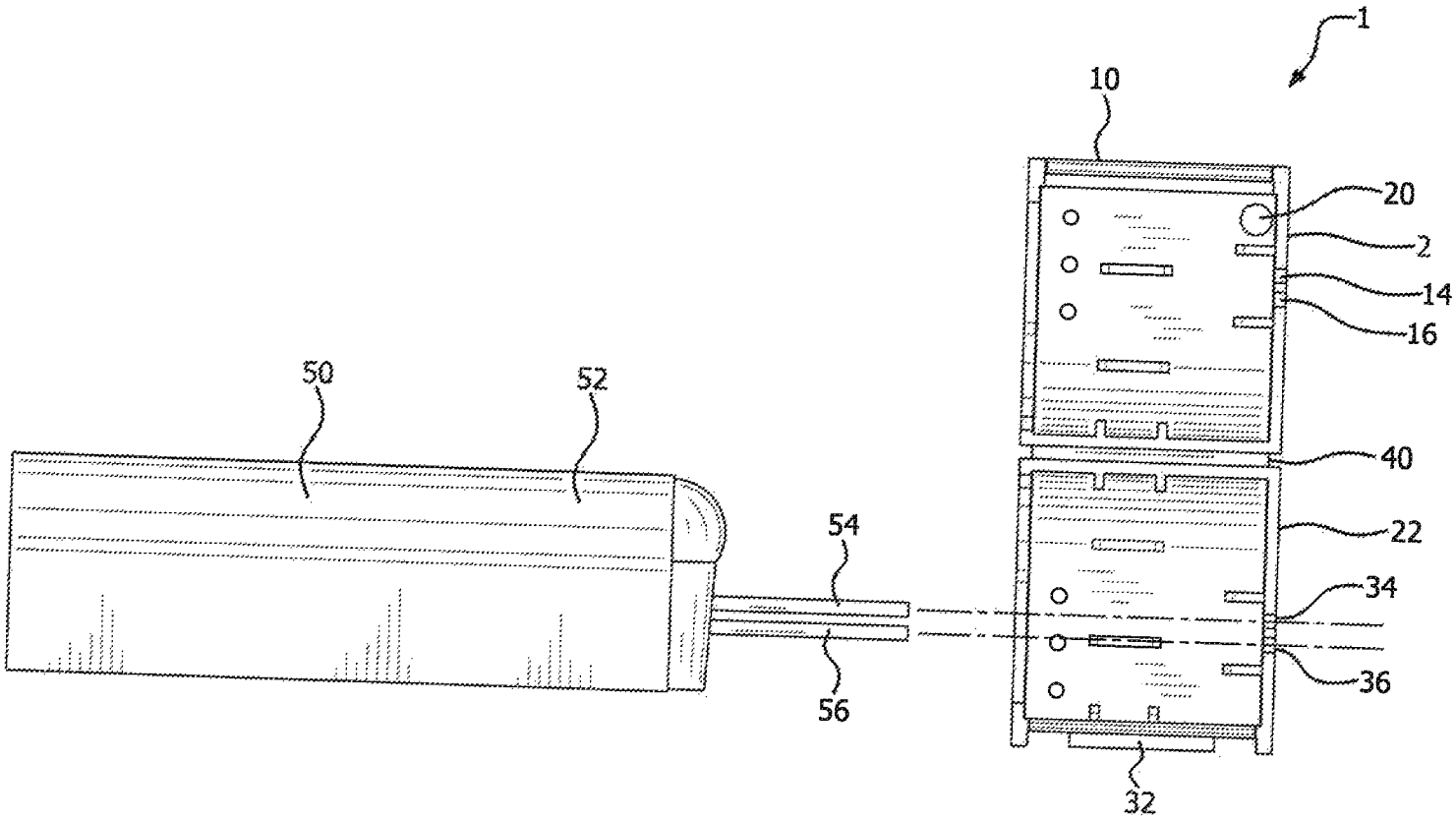
FIG. 3 is a top view of the end cap boot of the present invention, the end cap boot being aligned with the distal end of a neon lamp prior to being installed.
Figure 5:
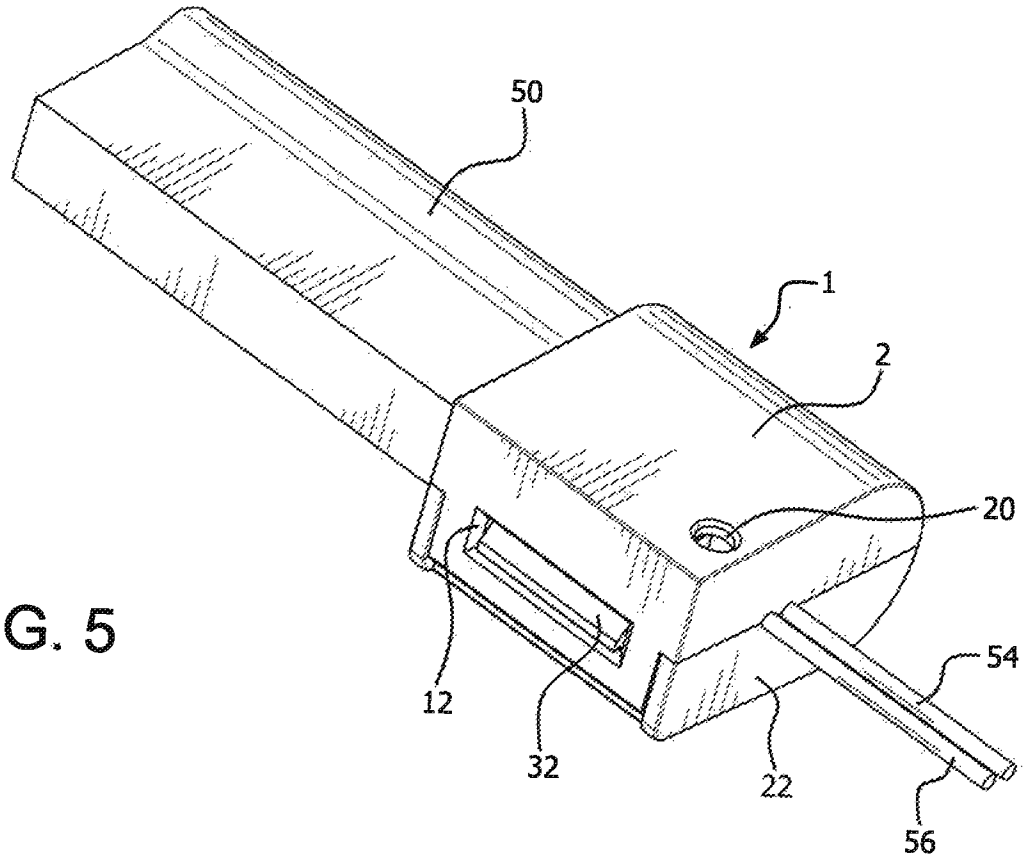
FIG. 5 shows the end cap boot of the present invention in its closed position, fully encompassing the distal end of the neon lamp.

End cap boot 1 has two relevant positions. In its first, or open position, first end cap cover 2 and second end cap cover 22 are aligned end-to-end, as seen in FIGS. 1 and 3. In its second or closed position, after rotation of first end cap cover 2 about hinge member 40, first end cap cover 2 and second end cap cover 22 overlay each other as shown in FIG. 5.

Figure 4:
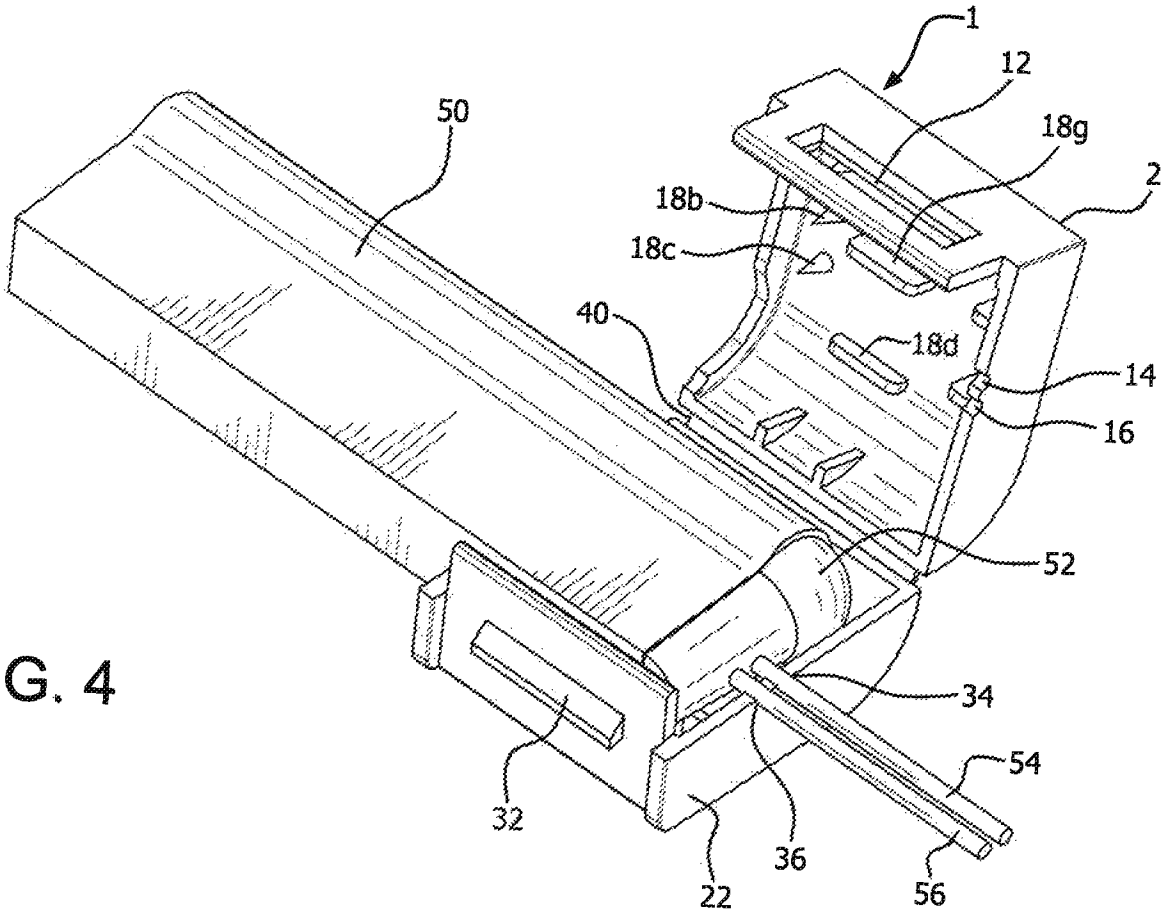
FIG. 4 shows the distal end of a neon lamp positioned within an end cap cover of the end cap boot of the present invention.

The use of end cap boot 1 and the method for its installation over the distal end of a neon lamp having electrical wiring is as follows. As best seen in FIG. 1, first end cap cover 2 and second end cap cover 22 are aligned in the first or open position, end-to-end, with distal end 52 of neon lamp 50. See FIG. 3. Distal end 52 of neon lamp 50 is then positioned within interior pocket 28 of second end cap cover 22, with its electrical wiring 54 and 56 placed within cut-out openings 34 and 36. See FIG. 4. First end cap cover 2 is then rotated over distal end 52 of neon lamp 50 such that the distal end is covered by the first end cap cover, the first end cap cover and second end cap cover 22 fully encapsulating the distal end of the lamp. Electrical wiring 54 and 56 are then also positioned within lateral cut-out openings 14 and 16 of first end cap cover 2. See FIG. 5. First end cap cover 2 and second end cap cover 22 are connected together by connection means, comprising tab 32 and slot 12, the tab being inserted into the slot. Spacer members 18*a*-18*h* and 38*a*-38*h* in end cap covers 2 and 22 respectively, serve to restrain distal end 52 of neon lamp 50 and to ensure a snug fit between the end cap covers and the neon lamp.

Figure 6:
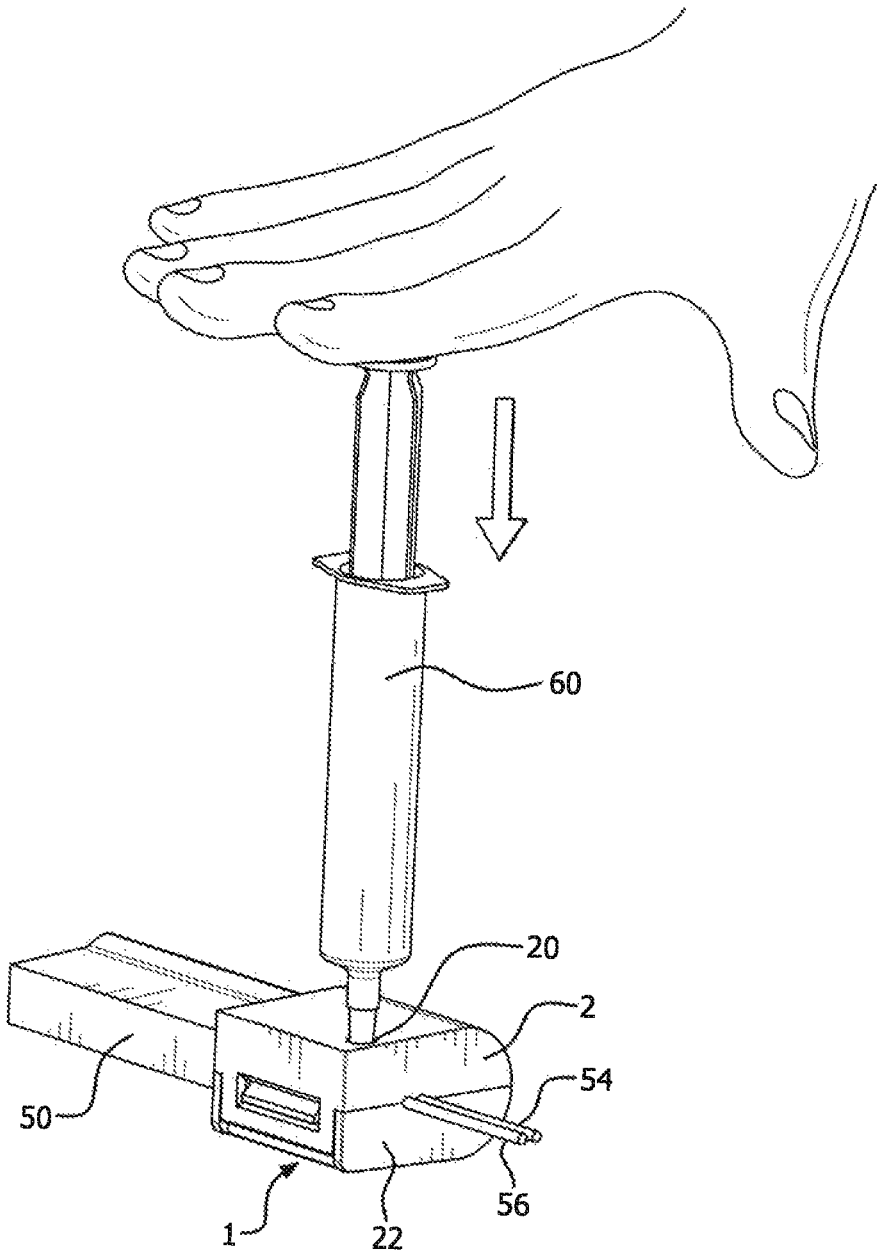
FIG. 6 illustrates the injection of glue material in accordance with the method of the present invention.

Glue material 60 is then injected, through port 20 in first end cap cover 2, as seen in FIG. 6, so that interior pockets 8 and 28 are completely filled with glue material.

It is also contemplated that end cap boot 1 and its method of installation can be used at the opposite distal end of a neon lamp, i.e. the end at which no electrical wiring extends out.

Thus, by utilizing end cap boot 1 and its method of installation at distal ends of neon lamps, an air tight, waterproof seal is accomplished at both distal ends of the lamp.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An end cap boot for neon lamps comprising:

a first end cap cover having a back wall, a side wall, and an interior pocket extending the entire length of the back wall and the entire width of the side wall, and a second end cap cover having a back wall, a side wall, and an interior pocket extending the entire length of said back wall and the entire width of said side wall, said first and second end cap covers being connected; wherein in a first position the first and second end cap covers are aligned end to end, and in a second position the first and second end cap covers overlay each other with the distal end of a neon lamp located therebetween and within the interior pockets of the first and second end cap covers, the distal end of the neon lamp being fully encapsulated by the end cap covers.

2. The end cap boot as in claim 1 further comprising connection means for attaching the first end cap cover to the second end cap cover in the second position.

3. The end cap boot as in claim 2 wherein the connection means comprises a slotted opening in an end wall of the first end cap cover and a tab on an end wall of the second end cap cover, said tab configured to snap into the slotted opening.

4. The end cap boot as in claim 1 further comprising a hinge member connecting the first end cap cover to the second end cap cover.

5. The end cap boot as in claim 4 further comprising connection means for attaching the first end cap cover to the second end cap cover in the second position.

6. The end cap boot as in claim 1 further comprising a through port located in the first end cap cover.

7. The end cap boot as in claim 6 further comprising connection means for attaching the first end cap cover to the second end cap cover in the second position.

8. The end cap boot as in claim 1 wherein the back walls of the first and second end cap covers comprise spacer members extending into the interior pockets of each end cap cover.

9. The end cap boot as in claim 8 further comprising connection means for attaching the first end cap cover to the second end cap cover in the second position.

10. The end cap boot as in claim 9 further comprising a hinge member connecting the first end cap cover to the second end cap cover.

11. The end cap boot as in claim 1 further comprising lateral cut-out openings in the first end cap cover and in the second end cap cover, wherein said lateral cut-out openings are configured to receive electrical wiring extending from the neon lamp.

12. The end cap boot as in claim 11 wherein the back walls of the first and second end cap covers comprise spacer members extending into the interior pockets of each end cap cover.

13. The end cap boot as in claim 12 further comprising connection means for attaching the first end cap cover to the second end cap cover in the second position.

14. The method of installing an end cap boot over the distal end of a neon lamp, the method comprising the steps of:

providing an end cap boot comprising a first end cap cover having a back wall, a side wall, and an interior pocket extending the entire length of the back wall and the entire width of the side wall, and a second end cap cover having a back wall, a side wall, and an interior pocket extending the entire length of said back wall and the entire width of said side wall, said first and second end cap covers being rotatably connected to each other;

aligning the first and second end cap covers end to end;

positioning the distal end of a neon lamp within the interior pocket of the second end cap cover;

rotating the first end cap cover over said end of the neon lamp such that the distal end of the neon lamp is covered by the first end cap cover and the first and second end cap covers fully encapsulates the distal end of the neon lamp;

connecting the first and second end cap covers together;

injecting glue material into the interior pockets of the first and second end cap covers; and completely filling the interior pockets encompassing the end of the neon lamp with glue material.

15. The method as in claim 14 comprising the further steps of providing lateral cut-out openings in the first and second end cap covers.

16. The method as in claim 15 comprising the further step of positioning electrical wiring extending from the neon lamp into the cut-out openings of the end cap covers, such that the wiring extends out of the end cap boot, prior to the injection of the glue material.

17. The method as in claim 14 comprising the further step of providing a through port in the first end cap cover into which the glue material is injected.

18. The method as in claim 14 comprising the further step of providing a slotted opening in the first end cap cover and a tab in the second end cap cover for connecting the first and second end cap covers together.

19. The method as in claim 14 comprising the further step of providing spacer members extending into the interior pockets of each end cap cover.

20. The method as in claim 14 comprising the further step of providing a hinge member connecting the first end cap to the second end cap.

* * * * *